United States Patent [19]

Scheer

[11] Patent Number: 4,748,549

[45] Date of Patent: May 31, 1988

[54] COLLAPSIBLE LIGHT FIXTURE WITH RESILIENT MOUNTING

[75] Inventor: Raymond D. Scheer, Pines, Fla.

[73] Assignee: Lamparas Europa, Spain

[21] Appl. No.: 85,893

[22] Filed: Aug. 14, 1987

Related U.S. Application Data

[63] Continuation-in-part of Ser. No. 902,172, Aug. 29, 1986, abandoned.

[51] Int. Cl.[4] ..... F21S 1/06

[52] U.S. Cl. ..... 362/406; 362/405; 362/427; 403/106

[58] Field of Search ..... 362/405, 406, 352, 370, 362/427; 248/56; 403/104, 105, 111, 327, 106; 285/330; 411/136, 138, 141, 145, 146, 149–151, 158, 326, 327, 329

[56] References Cited

U.S. PATENT DOCUMENTS

| | | | |
|---|---|---|---|
| 285,310 | 6/1883 | Shaffer . | |
| 528,926 | 11/1894 | Davis | 403/106 |
| 1,016,317 | 12/1909 | Benjamin . | |
| 1,071,938 | 12/1912 | McKechnie . | |
| 1,129,982 | 3/1915 | Hotchkin | 362/405 |
| 1,587,330 | 1/1925 | Kahns et al. . | |
| 1,796,330 | 1/1930 | Hotchkin . | |
| 1,956,846 | 5/1934 | Williams | 411/138 |
| 2,278,433 | 10/1940 | Elting . | |
| 2,657,941 | 11/1953 | Adzima | 280/301 |
| 3,365,220 | 1/1968 | Rusche | 285/330 |
| 3,604,913 | 9/1971 | Crete | 362/319 X |
| 3,622,779 | 1/1969 | Lagin . | |
| 3,831,022 | 8/1972 | Porter et al. . | |

FOREIGN PATENT DOCUMENTS

| | | | |
|---|---|---|---|
| 364725 | 6/1906 | France | 411/132 |

*Primary Examiner*—Samuel Scott
*Assistant Examiner*—Allen J. Flanigan
*Attorney, Agent, or Firm*—Steele, Gould & Fried

[57] ABSTRACT

A light fixture collapsible for shipping has rotatable and axially-displaceable arms that are resiliently urged toward a central body such that when the arms are re-aligned with the body upon unpacking the fixture, the resilient means urges a positioning pin to lock the arm in place. The fixture has a hollow body with a peripheral wall against which a plurality of arms are to extend radially outward. A post on one of the arm and the body extends into the other of the arm and the body, making the arms rotatable about their axes. A positioning pin on the arm and a hole in the body, or vice versa, engage when the arm is in alignment. A helical spring urges the arm toward the body.

16 Claims, 4 Drawing Sheets

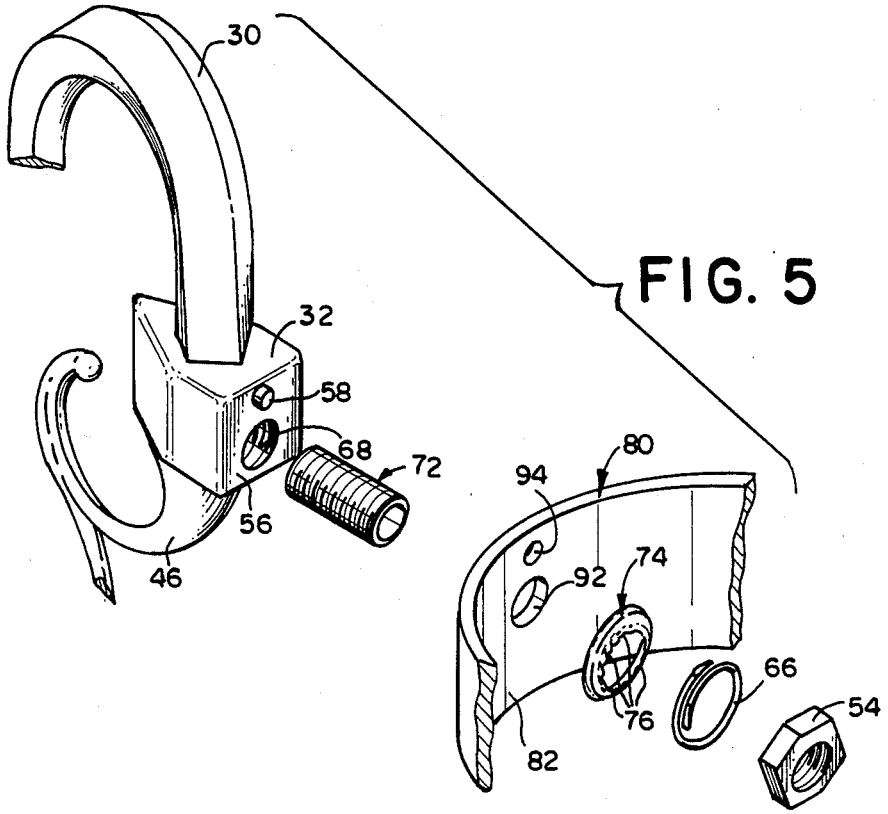
FIG. 5
FIG. 6
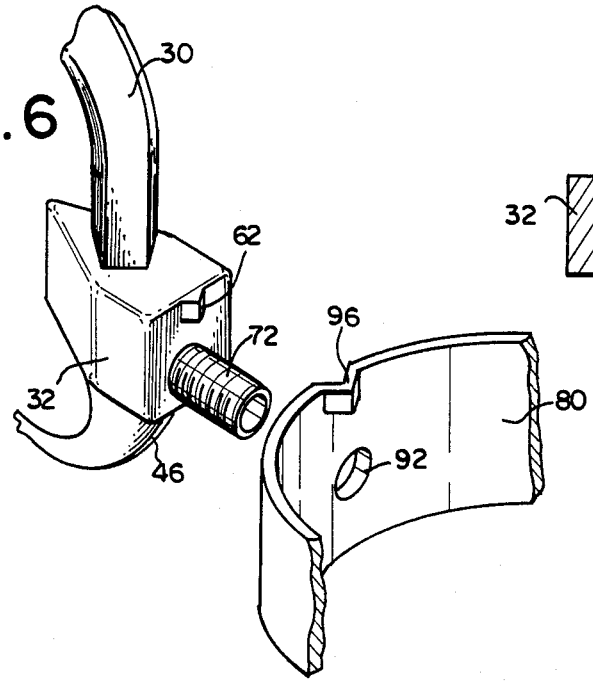
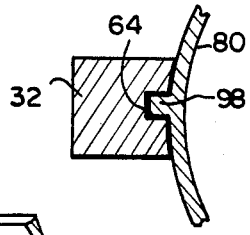
FIG. 7

COLLAPSIBLE LIGHT FIXTURE WITH RESILIENT MOUNTING

CROSS REFERENCE TO RELATED APPLICATION

This a continuation-in-part of copending application Ser. No. 902,172 filed Aug. 29, 1986, now abandoned.

BACKGROUND OF THE INVENTION

1. Field of the Invention

This invention relates to the field of collapsible light fixtures, and in particular to a light fixture that requires no assembly steps to attach disconnected parts, the fixture arms securely locking in place when simply brought into position.

2. Prior Art

Light fixtures such as assembled chandeliers are inherently wasteful of space in shipping. The fixtures are characterized by a plurality of arms radiating from a central body, each arm being a slender sinuous member adapted for carrying a lightbulb or the like at a distal end. Simply packing an assembled light fixture such as a chandelier in a box wastes a great deal of shipping space because the radiating arms define a large volume. Accordingly, the prior art has arrived at a number of ways for supplying light fixtures in knock-down form, such that the user can assemble the finished product from components in situ. Requiring a user to assembly a light fixture from its parts indeed achieves greater shipping efficiency. However, there are substantial difficulties in requiring users to assemble a light fixture from parts.

A first difficulty relates to making and protecting the electrical connections which are required to conductors from the arms to conductors in the central body. U.S. Pat. Nos. 1,024,809—Sechrist; 3,735,123—Porter, et al; and 1,059,742—Lumley teach devices which are intended to be wired during or immediately before certain mechanical assembly steps, mechanical connection between the light fixture arms and the central body being accomplished after the time the electrical connections are made. This procedure avoids the need for end users to make electrical connections but presents a substantial danger of electrical short or parting of factory-made electrical connections due to tension, because the chandelier arms remain freely movable with respect to the body. The devices of these patents are useful for saving space in shipping, but are demanding of the user to carefully and properly assemble the light fixture without placing undue strain on the connections and without exposing conductors to shorting against the fixture body.

The present invention also involves a form of collapsible arms for light fixtures such as chandeliers. However, with the invention, the electrical connections are made prior to shipping and due to the connection of parts, the connections remain safe. Only limited rotational displacement of the light fixture arms is required to properly position and fix in place the arms after unpacking. With the invention, the connections are protected because the arms are fully and finally mounted but for their rotational alignment to the central body of the fixture. When moved into place the arms lock.

U.S. Pat. Nos. 1,016,317—Benjamin and 3,831,022—Porter et al disclose light fixtures in which pre-mounted arms are collapsed for shipping and are opened outward for use. In Benjamin, four arms are folded over, two on two. In Porter, et al, three arms are folded to one side and two to the other. The light fixtures in these devices achieve an at least partial mechanical connection of the arms to the central body that remains in place during shipping. Accordingly, permanent electrical connections can presumably be made safely at the factory. However, the patents lack a simple means for positively bringing the arms into a fixed position. Instead, structural features requires the user to disassemble the light fixture and perform certain steps to lock the arms in place. More particularly, in Benjamin, a portion of the central housing having outwarding-directed slots is longitudinally displaceable on the central housing. The housing may thus be separated to allow the arms to be folded, and replaced when unfolded, thereby locking the arms at predetermined radial orientation relative to the body, as defined by the slots in the housing. Porter, et al has alternative positioning means including a system of asymetrical nuts that bear against the flat faces of a central polygon to lock the radiating arms in position. In alternative embodiments (FIGS. 14 and 15), Porter et al use an arrangement approaching the longitudinally displaceable central body idea of Benjamin.

The Benjamin and Porter, et al devices are useful for conserving shipping space and are relatively easy to assembly. Nevertheless, they require that the user at least partly disassemble the fixture in order to achieve the required mechanical alignments. This will necessarily expose electrical connections to damage, shorting and the like because tension on the wires and lateral displacement of the wires against the housing are unavoidable. Furthermore, light fixtures of this type are frequently shiny brass articles that are in large part made from sheet metal and are easily dented and/or scratched by any contact. Accordingly, any disassembly and reassembly whatsoever is apt to damage the fixture, particularly if tools are required.

According to the invention, the arms are rotated about their axes to fold the apparatus. The arms are resiliently mounted such that each individual arm need only be rotated a fraction of a revolution back into unfolded aligned position and the arm will automatically lock in that position. When aligned, a pin on one of the arm and body drops into a corresponding positioning hole on the other, defining the aligned position. The invention therefore achieves the objects of folding the arms for efficient shipping, protection of electrical connections, and reassembly without tools. There is no requirement that even a single part be removed and replaced.

Positioning holes have been used in prior art light fixtures for locking the alignment of radiating arms to a central body. This may be achieved by using non-round tube shapes and mating holes, or by providing a means to receive an off-center protrusion or outrigger. U.S. Pat. Nos. 1,587,330—Kahns, et al 3,622,779—Lagin have eccentric holes adapted to receive a protrusion affixed to radiating fixture arms. In Lagin, the protrusion is a tab having rectangular cross-section, fittable into a slot, the tab being affixed to the arm by means of a flanged split tube that is fitted over the arm. Kahns, et al employs a non-round washer, the washer having a protruding pin bent parallel to the longitudinal axis of the arm, to engage an off-center positioning hole. These patents are concerned with assembly steps at the factory or the like using tools, rather than collapsing for shipping. Even if extended to shipping, both the Lagin and Kahns, et al patents require substantial assembly steps by the user in situ. The patents do not teach resilient means seeking proper alignment of the parts, but rather only rigidly-connectable pieces that, once aligned upon assembly and tightened as necessary, will hold correct alignment. Therefore, the devices in these patents do not assist the user is protecting electrical connections, or in achieving assembly of an aligned device without tools and mechanical connection steps.

U.S. Pat. Nos. 285,310—Schaffer discloses a fuel-burning lamp having means for realigning two oppositely-directed flame-supporting elements with respect to a base, such that the flame elements (e.g., candles, oil lamps or the like) can be positioned operatively upright either when the base is set upright or aligned horizontally, for example by attachment to a wall. A splined member attached to the connected arms is urged toward a keyway by means of a spring. Although this patent shows that springs and keys can be used in positioning, it fails to disclose how such a device could be adapted to a situation in which the arms were foldable rather than rigidly attached or how similar means might be useful in the case of electric wires routed to the arms.

Other prior art devices in which light fixtures are made collapsible for shipping or ease of assembly are shown in U.S. Pat. Nos. 1,071,938—McKechnie; 1,796,330—Hotchkin and 2,278,433—Elting. These patents show ways in which other inventors have attempted to solve the problems of collapsible light fixtures.

The invention disclosed and claimed herein is directed to solving some of the same problems as prior art collapsible fixtures. However, the invention solves shipping space problems in a manner that protects electrical connections and requires no actual assembly whatsoever. All the user is required to do is to manually move the arms into alignment, whereupon the product is complete and correct alignments are fixed. The maximum rotation which could ever be required to unfold a collapsed arm is less than a full revolution and the axial displacement of the arms is very small, thereby protecting the electrical wires. A nut compresses a spring resiliently urging each arm into engagement with the central body along axes of the arms. Means are also provided defining a rational detent lockwasher arrangement, resisting loosening of the device even with repeated disengagement and reengagement. The invention allows the arms of the chandelier to be folded flat for shipping, thereby conserving space. The fixture is safely made operative by the least mechanically adept of users.

The device facilitates assembly and also protects shiny brass and sheet metal parts from scratches, dents and the like. The invention is therefore readily useable with replaceable bobeche devices and the like, for example as shown in applicant's prior U.S. Pat. No. 4,590,545.

SUMMARY OF THE INVENTION

It is an object of the invention to provide a collapsible chandelier that requires no assembly of parts to bring the device permanently into an un-collapsed, aligned and finished condition.

It is also an object of the invention to conserve shipping space in a collapsible light fixture, with minimum danger of damage to shiny brass and sheet metal parts.

It is another object of the invention to provide a collapsible chandelier that can have all possibly-dangerous and/or short-prone electrical and mechanical connections made once and for all at the factory.

It is still another object of the invention to provide a collapsible self-aligning chandelier that can be re-collapsed and thereafter re-assembled.

These and other objects are accomplished by a light fixture having a hollow body with a peripheral wall, the wall having arm mounting means and positioning means for receiving rotatable but fixable arms therein. A plurality of arms extend outward from the hollow body, each arm being movably affixed to the hollow body at the arm mounting means, one of the arm and the body having a post extending into a corresponding arm mounting hole in the other of the arm and body, such that the arm is rotatable, one of the arm body having a pin spaced off center from the post and positioned to extend into a positioning hole in the other of the arm and the body, whereupon the arm is aligned to the body. Resilient means are provided to urge together the arm and body, bringing the pin into engagement with the positioning hole when the arm is properly aligned, thereby rotationally fixing the arm relative to the body, this alignment occurring at a fraction of a revolution of the arm around the axis of the post.

In alternative embodiments, the pin may be placed on the body or on the arm, with a corresponding detent depression, hole or the like functioning as the positioning hole in the opposed one of the arm and body. The resilient means is preferably a helical spring compressed by a nut and adapted to engage a lock washer. Electrical wires run through the post, which is preferably a hollow threadable tube, and also through the lock washer, spring, mounting opening and nut. In order to install the chandelier, the user need only make external electrical connections, and simply align the arms, snapping them into alignment as the positioning pins extend into the positioning holes.

BRIEF DESCRIPTION OF THE DRAWINGS

There are shown in the drawings the embodiments that are presently preferred. It should be understood that the invention is not limited to the precise arrangements and instrumentalities shown in the drawing, wherein:

FIG. 5 is a partial exploded view showing the respective parts connecting the arm and body.

FIG. 6 is an exploded view of an alternative embodiment.

FIG. 7 is a section view, in plan, through a positioning pin and arm block of an alternative embodiment.

DETAILED DESCRIPTION OF THE PREFERRED EMBODIMENTS

Figure 1:
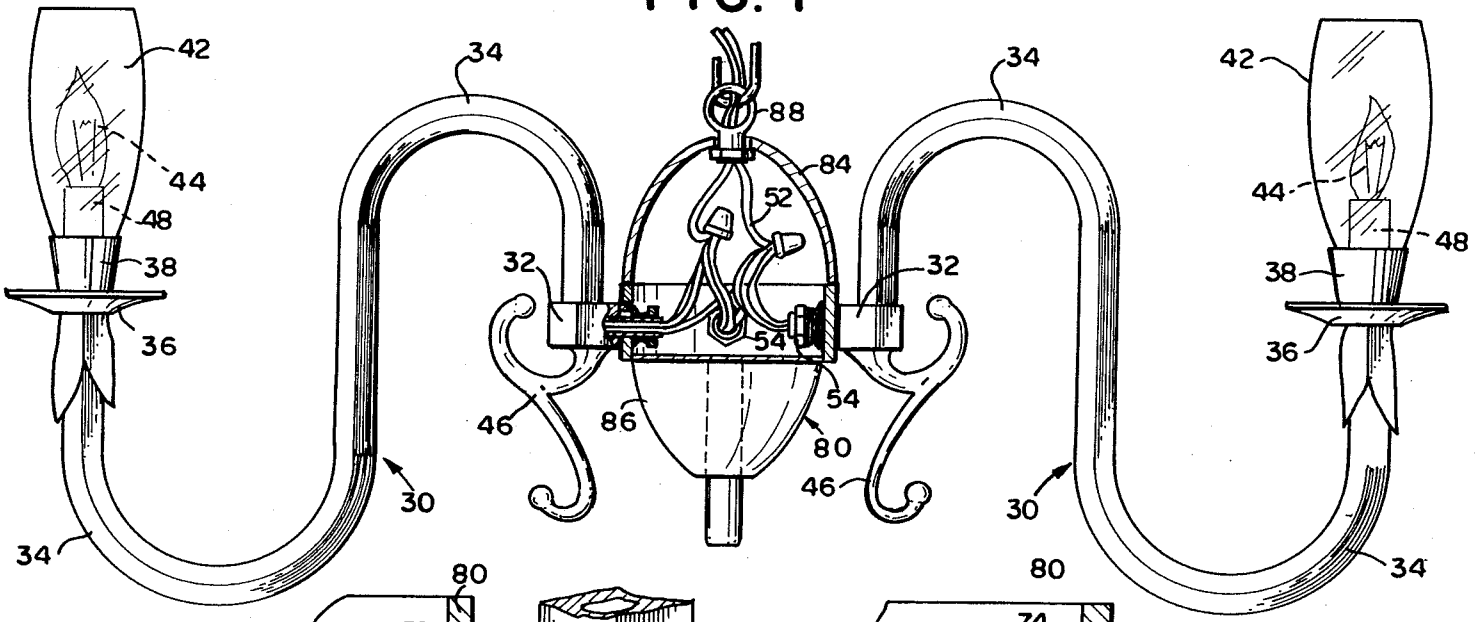
FIG. 1 is an elevation view of a light fixture according to the invention, part of the central hollow body being cut away.

FIG. 1 shows a light fixture according to the invention, having a plurality of arms 3, radiating from a central body 80. Body 80 can be mounted, for example, at the central axis of a hanging chandelier, at the distal end of a standing floor lamp or table lamp or the like, or otherwise disposed as a source of light for an area. Arms 30 radiate generally symmetrically, and in FIG. 1 two arms that extend upwards and downwards from the plane of the drawing are not shown, the central portion being partly cut away to illustrate connection features.

Each arm 30 carries at least one light bulb 44, for example at the free end. Electrical wires 52 extend through the arms back to common connection points, usually in body 80, at which the conductors to the bulbs are connectable to a source of power. In the embodiment shown in the drawings, the light fixture can have a glass chimney 42, candle cup 38, bobeche 36 and decorative scroll 46. It will be appreciated that the invention is likewise applicable to other types of light fixtures and electrical apparatus with conductor-carrying arms radiating from a hub.

The individual arms 30 have a block 32, at which the arms are connected to the central body. The arms are characterized by a sinuous shape, including bends 34. Each arm 30 is substantially confined to a plane, for example a vertical plane radiating from the longitudinal axis of body 80. By virtue of bends 34, each arm takes up a large area within its plane and, together with the remaining arms 30 define quite a substantial volume, typically ranging up to a cubic meter even in a modest chandelier. The central body can be the same height as the arms, or of a different size. Most frequently the central body is relatively small in comparison to the arms, in both vertical and horizontal dimensions. The central body may or may not include separable upper housing 84 and lower housing 86, and may include such features as switches, a ceiling fan, or other alternative details.

Figure 2:
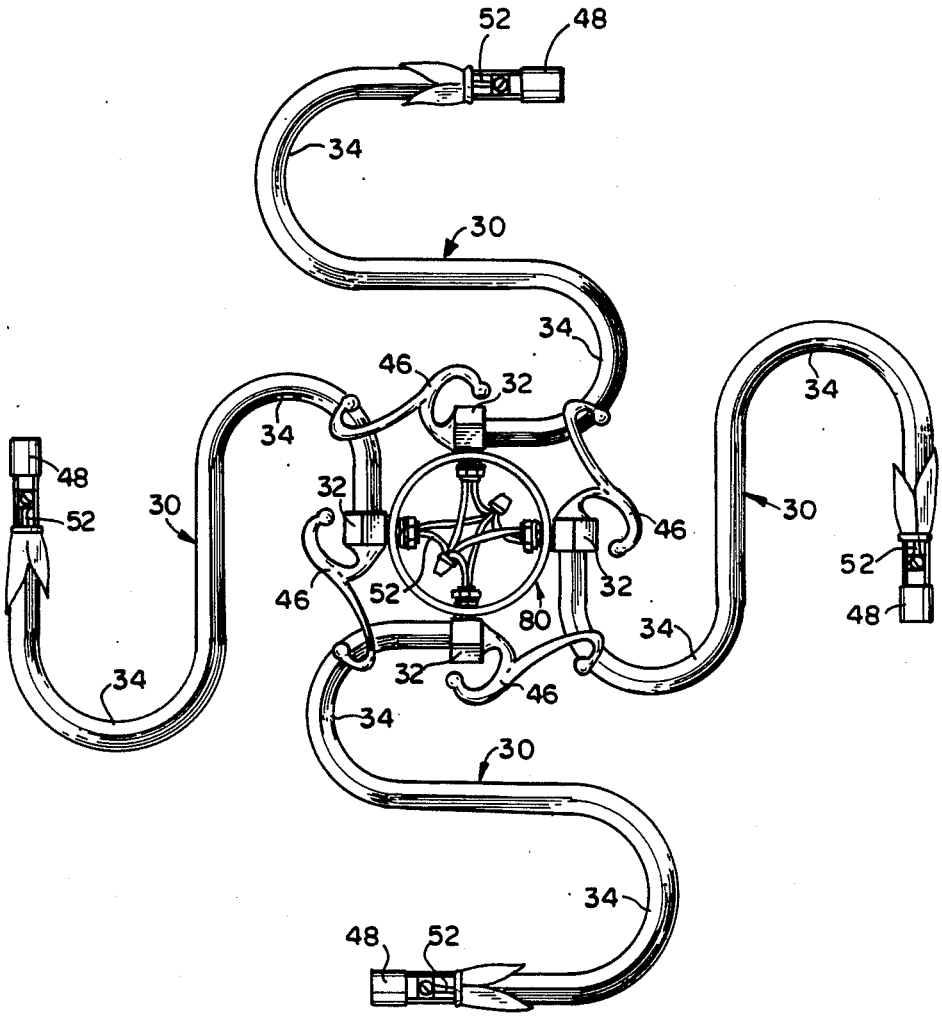
FIG. 2 is an elevation view of the light fixture, the arms shown in folded position, the hollow body being partly cut away and the electrical bulb fixtures being shown.

In FIG. 2, the individual arms 30, shown aligned in FIG. 1, are shown collapsed for purposes of shipping. The engagement structure by which arms 30 are aligned to housing 80, and in particular to a ring portion 82 of housing 80, is resilient. Corresponding mating structures on blocks 32 of arms 30 and central body 80 are resiliently pressed into engagement when the arms are aligned (for example vertically), and allow rotation when blocks 32 are pulled back from ring 80, against resilient force of the mounting.

When the individual arms 30 are folded such that the planes defined by arms 30 and their curves 34 are brought into nearly the same horizontal plane, the overall light fixture is substantially reduced in height. The light fixture has the same length and width, but depending on the arm layout may be reduced in height from nearly a meter to only 10 centimeters or so, a savings in volume of 90%. The individual arms 30 need not be folded absolutely flat, to all occupy the identical same horizontal plane. Alternatively, as shown in FIG. 2, it is possible to have the arms partly overlap one another, each folded arm partly resting against the next arm. In FIG. 2, decorative scrolls 46 bear upon the innermost curve 34 of arm 30 on the next adjacent arm.

FIG. 2 also shows the bulb socket 48, which is connected by means of wires 52 to central connections within the body 80. These bulb sockets may also be attached and wired prior to assembly, for example using removable bobeche and candle cup structures as shown in applicant's U.S. Pat. No. 4,590,545. In this way, the bobeches are safe from damage due to edgewise contact against any packing material or the like.

Electrical connections by means of wires 52, and the screw terminals or connecting caps at the bulb sockets or central body, respectively, are not substantially disturbed by minimal rotation of arms 30 around their connecting blocks 32. Wires 52 remain in position, and are not threatened by extreme twisting or longitudinal force tending to dislodge the wires from the common connections.

In an alternative embodiment, two or more detent positions are provided in which the alignment of the arms to the body remains secure. One of the detents can define a folded condition for shipping and the other can define the aligned position. The arms are rotatably fixable at either alignment by corresponding mating structures.

Figure 4:
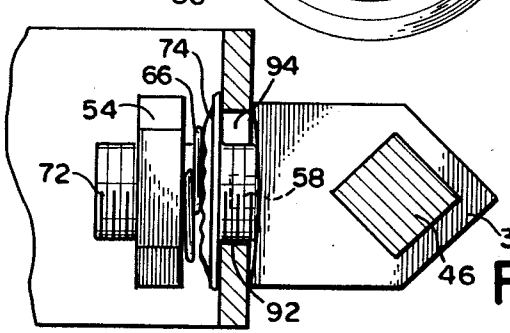
FIG. 4 is a section view corresponding to FIG. 3 but taken along lines 4—4 in FIG. 2, the arm being shown folded.
Figure 3:
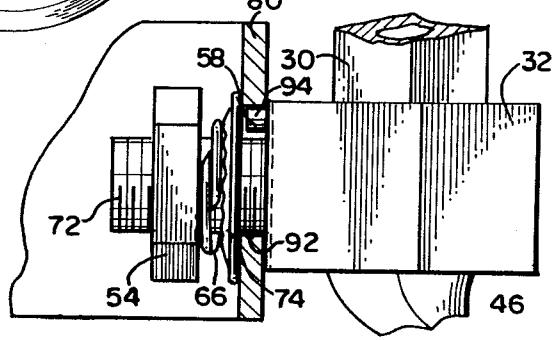
FIG. 3 is a detailed section view showing the connection between the arm and the body in FIG. 1.

A particular preferred embodiment of the engagement structure between blocks 32 of arms 30 and the chassis ring of body 80, is shown in FIGS. 3–5. FIG. 3 is a detailed section view showing connection of one of the arms as appears in FIG. 1. A threaded steel tube 72 is threaded into block 32 of arm 30, and extends from block 32 inwardly through a mounting opening 92 in body 80. Positioning pin 58, which is spaced off center from tube 72, engages in positioning hole 94 in body 80, holding arm 30 in aligned position. Arm 30 is urged toward body 80 by the action of spring 66. Nut 54 bears against spring 66 and lock washer 74, urging arm 30 against body 80 and urging the corresponding mating structures to engage. Nut 54 and body 80 can thereafter be separated by at least the length of pin 58, by comprising spring 66 under nut 54, whereupon the arm 30 is again rotatable.

Body 80 is preferably a cylindrical shape. In that case, block 32 is provided with a slight curvature on its surface directed toward body 80 such that block 32 and body 80 directly abut. When arm 30 is rotated out of alignment as shown in FIG. 4, pin 58 bears against the outer wall of body 80 in the area adjacent positioning hole 92. Due to the length of pin 58 and also due to the curvature of block 32 on the side facing body 80, rotation of arm 30 tends to compress helical spring 66 between nut 54 and lockwasher 74. Nut 54 should be only just loose enough to allow rotation of arm 30. The fixture can be assembled at the factory with the arm in the position shown in FIG. 4, and nut 54 threaded down tightly enough to substantially compress spring 66. When the arm is rotated upright as shown in FIG. 3, spring 56 will pull pin 58 into hole 94, mechanically holding the arm in aligned position.

In FIG. 5, the respective parts are shown in exploded view. Preferably, the basic mounting posts are defined by threaded tubes 72, threaded into the threaded opening 68 in block 32 of arm 30, and engaged by nut 54 on an opposite side of the peripheral wall of body 80. In this manner, tube 72 is extended through positioning hole 92 in body 80, and but for pin 94 would allow free rotation of arm 30 around an axis defined by tube 72. Pin 58 is rigidly fixed in block 32, however, and fixes arm 30 in aligned position when pin 58 is disposed in positioning hole 94, spaced slightly from mounting hole 92. Preferably, block 32 of arm 30 is a solid brass block, and pin 58 is a steel pin that is force fit into a hole bored in block 32. It is also possible to form pin 58 integrally with arm 30 and block 32, for example forming a detent protrusion 62 as shown in FIG. 6. Such a protrusion could likewise engage a detent 96 in body 80. In other words, positioning hole 94 can be defined by a detent 96, or by a hole bored or molded through the wall of body 80. As noted above, a plurality of detents can be provided to define selectable alignments at which the arm is secure.

It is also possible to reverse the order of the pin and hole on the block and chassis, respectively. In FIG. 7, block 32 has the detent depression 64, and is adapted to receive a positioning pin 98, integrally formed with the peripheral wall of body 80, or otherwise affixed thereto to extend toward block 32.

FIG. 5 shows the preferred arrangement for the resilient biasing means urging block 32, and therefore pin 58, toward the wall of body 80. Spring 66 is preferably a helical spring that has only a few windings (e.g., one or two), the windings being spaced at rest. Spring 66 is preferably spring steel and should be relatively stiff. Inasmuch as only a few turns are used, helical spring 66 has protruding ends. One of these ends bears against lockwasher 74. Lockwasher 74, which is ridged but otherwise substantially conical, is aligned such that the outer circumference of lock washer 74 bears against hollow body 80, and the inner conical edge bears more closely against helical spring 66. Lock washer 74 is preferably a steel washer that is bent into a substantially conical shape, with a plurality of humps and/or depressions defining ridges extending radially and running along the surface of the washer from the central hole to the exterior edge. These humps or depressions 76, engage a protruding end of helical spring 66. The other end of helical spring 66 bears against nut 54. Inasmuch as washer 74 is conical, there is a relatively limited surface engagement between washer 74 and the inner wall of body 80. Accordingly, when arm 30 is rotated, nut 54, helical spring 66 and washer 74 tend to rotate as a unit together with arm 30, thereby avoiding loosening nut 54 and allowing the light fixture to be again collapsed and re-aligned without loss of rigidity due to loosening of the connection.

According to the invention, the light fixture is assembled at the factory to compress spring 66 substantially down against lock washer 74 when the pins of the arms are not aligned with their respective detent holes. This just allows the user to rotate arm 30 into alignment, locking arm 30 by means of its pin 58 resting in the detent or positioning hole 94. Inasmuch as pin 58 will come into alignment with hole 94 in less than a full revolution of arm 30, there is no possibility of substantially disturbing electrical wires running through threaded tubes 72. Nevertheless, good mechanical connection remains due to pin 58 in hole 94, and also due to the inherent alignment of tube 72 in hole 92 and the curving face of block 32 resting against the rounded outer face of body 80.

Figure 8:
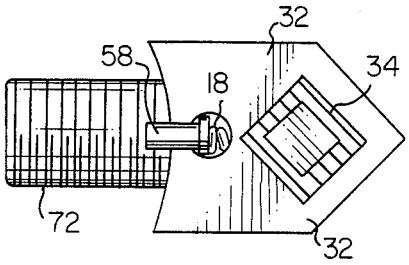
FIG. 8 is a partial section view of the area of block 32 taken along lines 8—8 in FIG. 5 and referring to an alternative embodiment.
Figure 9:
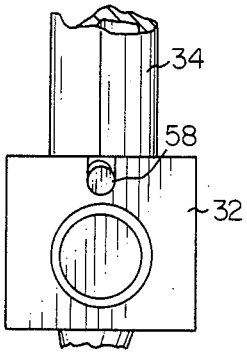
FIG. 9 is an elevation view taken along lines 9—9 in FIG. 5 and corresponding to FIG. 8.

According to another preferred embodiment as illustrated in FIGS. 8 and 9, the pin 58 is retractable into the block 32 of arm 30. In this embodiment, the pin mounting can be the only resilient element in the connection, or the resiliently-retractable pin can be employed in addition to a compressible washer on threaded tube 72, as in the previous embodiments.

In FIG. 8, pin 58 is formed by a stud having an enlarged head disposed in a bore in block 32, oriented perpendicular to the axis of pin 58. A spring 18 urges the pin forwardly and the bore is sufficiently large to allow retraction of pin 58 as necessary for free rotation of threaded tube 72 in mounting hole 92. A slot 16, as shown in FIG. 9, allows easy insertion of the pin according to this embodiment.

Figure 10:
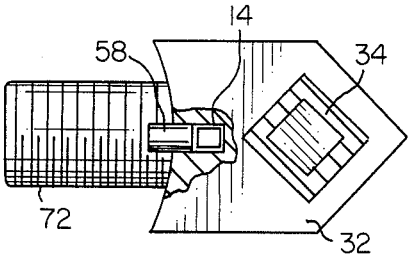
FIG. 10 is a partial section view of the area of block 32 corresponding to FIG. 8 but illustrating another embodiment of the invention.
Figure 11:
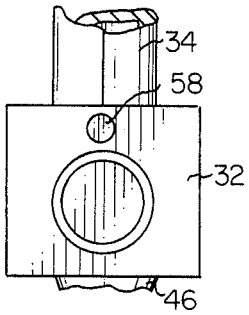
FIG. 11 is a partial elevation view corresponding to FIG. 9, but referring to the embodiment of FIG. 10.

Another preferred embodiment, illustrated in FIGS. 10 and 11, employs a cylindrical pin 58 with a resilient spring-like pad 14 urging pin 58 outwardly. Pin 58 is not positively retained in position in the embodiment of FIGS. 10 and 11, but will remain captive between block 32 and washers disposed on an opposite side of the carrier ring 80 from block 32. Resilient pad 14 can be a soft plastic or rubber pad that is simply inserted prior to insertion of pin 58 upon assembly of the light fixture arms and body.

In FIG. 10, the portion of body 32 adjacent pin 58 is shown partly cutaway. As seen in FIG. 11, pin 58 fits into a simple bore running parallel to the axis of threaded tube 72.

According to the embodiments of FIGS. 8–11, the pin is mounted resiliently. This arrangement may be employed together with a resilient washer or spring arrangement as in FIGS. 3 and 4, or alternatively, a flat washer can be employed inside of body 80, and the resilience of mounting of pin 58 can be relied upon for allowing rotation of block 32 into its aligned position.

A number of additional variations and embodiments within the scope of the invention will now occur to persons skilled in the art made aware of this disclosure. Reference should be made to the appended claims rather than the foregoing specification as indicating the true scope of the invention.

What is claimed is:

1. A collapsible light fixture, comprising:

a hollow body with a peripheral wall having arm mounting means and positioning means;

a plurality of arms, each arm extending outward from the hollow body and being movably affixed to the hollow body at the arm mounting means, one of the arm and the body having a post extending into a corresponding arm mounting hole in the other of the arm and body, the post being rotatable in the arm mounting hole such that the arm is rotatable relative to the body, one of the arm and the body having a pin spaced from the post and positioned to extend into a positioning hole in the other of the arm and the body, the arm being aligned to the body when the pin is disposed in the positioning hole; and, resilient means urging the arm toward the body.

2. The light fixture of claim 1, further comprising a stop on the post, the stop preventing displacement of the arm from the body by more than a predetermined distance, the pin being shorter that the predetermined distance.

3. The light fixture of claim 1, wherein each of the arms has a sinuous shape in a plane extending radially from the body, whereby rotating the arms out of alignment stacks the planes and collapses the light fixture.

4. The light fixture of claim 2, wherein the post is externally threaded and the stop is a nut on the post inside the body, the resilient means being disposed between the nut and the peripheral wall of the body.

5. The light fixture of claim 4, wherein the post is an externally threaded tube, the post being threaded into the arm and the arm having a block defining a flange bearing against the peripheral wall.

6. The light fixture of claim 1, wherein the arm mounting hole is in the body and the post is attached to the arm.

7. The light fixture of claim 1, wherein the positioning hole is in the body and the pin protrudes from the arm.

8. A light fixture, comprising:

a body having a peripheral wall with arm mounting holes and positioning holes disposed therein;

a plurality of arms movably affixed to the body, each arm extending outward from the body at the arm mounting holes, the arm having a post extending into a corresponding one of the arm mounting holes such that the arm is rotatable, the arm having a pin spaced from the post and positioned to extend into a corresponding one of the positioning holes, whereupon the arm is aligned to the body; and, resilient means urging the pin toward the position hole.

9. The light fixture of claim 8, wherein the post is a threaded tube threaded into a bore in the arm, electrical wires being carried in the tube, and further comprising a nut on the tube, the nut being disposed inside the body, the resilient means being disposed between the nut and the body.

10. The light fixture of claim 9, wherein the pin is a protrusion of the arm and the positioning hole is a detent in the body.

11. The light fixture of claim 9, wherein the pin is a protrusion of the body and the positioning hole is a detent in the arm.

12. The light fixture of claim 9, wherein the resilient means comprises a helical spring.

13. The light fixture of claim 9, further comprising a lock washer on the post, the lock washer having a plurality of spaced detents, the nut being rotationally fixed on the tube by the lock washer, whereby rotation of the arm does not loosen the nut.

14. The light fixture of claim 12, wherein the lock washer is ridged and is disposed against the helical spring, the helical spring having a first end disposed against ridges forming detents in the lock washer and a second end disposed against the nut.

15. The light fixture of claim 8, wherein the pin is movably mounted in the arm, and the resilient means comprises a resilient element disposed behind the pin.

16. The light fixture of claim 15, wherein the pin is captive in the arm.

* * * * *